US007644599B2

(12) United States Patent
Hoffmann-Ivy et al.

(10) Patent No.: US 7,644,599 B2
(45) Date of Patent: Jan. 12, 2010

(54) METHOD FOR SURFACE BLASTING CAVITIES, PARTICULARLY CAVITIES IN GAS TURBINES

(75) Inventors: Stephen Hoffmann-Ivy, Karlfeld (DE); Patrick Cheppe, Basse Goulaine (FR); Jean-Michel Duchazeaubeneix, Les Sorinieres (FR); Erwin Bayer, Dachau (DE)

(73) Assignees: MTU Aero Engines GmbH, Munich (DE); Sonats, Carquefou Cedex (FR)

( * ) Notice: Subject to any disclaimer, the term of this patent is extended or adjusted under 35 U.S.C. 154(b) by 169 days.

(21) Appl. No.: 11/792,756

(22) PCT Filed: Dec. 7, 2005

(86) PCT No.: PCT/DE2005/002205

§ 371 (c)(1),
(2), (4) Date: Jul. 6, 2007

(87) PCT Pub. No.: WO2006/061004

PCT Pub. Date: Jun. 15, 2006

(65) Prior Publication Data

US 2009/0095042 A1 Apr. 16, 2009

(30) Foreign Application Priority Data

Dec. 10, 2004 (DE) ..... 10 2004 059 592

(51) Int. Cl.
*B23P 15/00* (2006.01)
*B24C 1/00* (2006.01)

(52) U.S. Cl. ..... 72/53; 29/90.7; 451/38; 451/39

(58) Field of Classification Search ..... 72/53; 29/90.7; 451/38, 39
See application file for complete search history.

(56) References Cited

U.S. PATENT DOCUMENTS

| | | | |
|---|---|---|---|
| 3,668,912 | A | 6/1972 | Baughman et al. |
| 3,668,913 | A | 6/1972 | Morris |
| 3,695,091 | A | 10/1972 | Smith |
| 4,108,689 | A | 8/1978 | Peter et al. |
| 4,115,076 | A | 9/1978 | Hitzrot, Jr. |
| 4,350,035 | A | 9/1982 | Kopp et al. |
| 4,694,672 | A | 9/1987 | Baughman |
| 4,888,863 | A | 12/1989 | Cox et al. |
| 4,974,434 | A | 12/1990 | Reccius et al. |
| 5,085,747 | A | 2/1992 | Nikano |
| 5,443,201 | A | 8/1995 | Cartry |
| 5,509,286 | A | 4/1996 | Coulon |
| 5,596,912 | A | 1/1997 | Laurence et al. |

(Continued)

FOREIGN PATENT DOCUMENTS

| | | |
|---|---|---|
| FR | 2 815 280 | 4/2002 |

(Continued)

*Primary Examiner*—David B Jones
(74) *Attorney, Agent, or Firm*—W. F. Fasse; W. G. Fasse

(57) ABSTRACT

In a method for surface blasting hollow spaces or cavities, especially cavities of gas turbines, shot balls are accelerated with the aid of at least one vibrator, whereby the ultrasonically accelerated shot balls are directed onto surfaces of a cavity that is to be blasted. The vibrator is preferably positioned with a small spacing distance, preferably on the order of magnitude of the diameter of the shot balls utilized for the blasting, from the cavity to be blasted.

28 Claims, 4 Drawing Sheets

U.S. PATENT DOCUMENTS

| | | | | |
|---|---|---|---|---|
| 5,771,729 | A | 6/1998 | Bailey et al. | |
| 5,820,011 | A | 10/1998 | Ito et al. | |
| 5,829,116 | A | 11/1998 | Vilon | |
| 5,950,470 | A | 9/1999 | Prewo et al. | |
| 6,170,308 | B1 | 1/2001 | Veronesi et al. | |
| 6,289,705 | B1 | 9/2001 | Duquenne et al. | |
| 6,336,844 | B1 | 1/2002 | Duquenne et al. | |
| 6,343,495 | B1 | 2/2002 | Cheppe et al. | |
| 6,383,317 | B1 | 5/2002 | Bellus et al. | |
| 6,467,321 | B2 | 10/2002 | Prokopenko et al. | |
| 6,490,899 | B2 | 12/2002 | Berthelet et al. | |
| 6,505,489 | B2 | 1/2003 | Berthelet et al. | |
| 6,508,093 | B2 | 1/2003 | Berthelet et al. | |
| 6,536,109 | B2 | 3/2003 | Berthelet et al. | |
| 6,584,820 | B1 | 7/2003 | Benedict et al. | |
| 6,938,448 | B2 | 9/2005 | Kennerknecht et al. | |
| 7,028,378 | B2 | 4/2006 | Cheppe et al. | |
| 7,140,216 | B2 | 11/2006 | Garza | |
| 7,181,944 | B2 | 2/2007 | Wuestefeld et al. | |
| 7,389,663 | B2 * | 6/2008 | Cheppe et al. | 72/53 |
| 7,481,088 | B2 * | 1/2009 | Bayer et al. | 72/53 |
| 2002/0124402 | A1 | 9/2002 | Berthelet et al. | |
| 2003/0005736 | A1 | 1/2003 | Inoue et al. | |
| 2003/0115922 | A1 | 6/2003 | Berthelet et al. | |
| 2006/0021410 | A1 | 2/2006 | Cheppe et al. | |
| 2006/0174483 | A1 | 8/2006 | Bayer et al. | |
| 2007/0214640 | A1 | 9/2007 | Bayer et al. | |

FOREIGN PATENT DOCUMENTS

| | | |
|---|---|---|
| GB | 2 250 931 | 6/1992 |
| JP | 07-308859 | 11/1995 |
| WO | WO 2005/123338 | 12/2005 |

* cited by examiner

METHOD FOR SURFACE BLASTING CAVITIES, PARTICULARLY CAVITIES IN GAS TURBINES

FIELD OF THE INVENTION

The invention relates to a method for the surface blasting of hollow spaces or cavities, especially cavities of gas turbines.

BACKGROUND INFORMATION

Gas turbines, especially aircraft engines, have at least one rotor equipped with rotating runner or rotor blades especially in the area of a compressor as well as a turbine, whereby the rotor blades are increasingly embodied as an integral component of the rotor. Integral bladed rotors are also designated as "blisk" (bladed disk) or "bling" (bladed ring). Generally, through-going bored holes, extending in the radial direction, for fluids, for example oil, are generally integrated in such rotors. Such through-going bored holes are also designated as "bleed holes" and represent hollow spaces or cavities with small cross-sectional areas. Other bored holes extend in the axial direction and often serve for the screwing connection, whereby these bored holes similarly represent highly loaded zones or areas of compressor and turbine. Further cavities with small-cross sectional areas are, for example, located between neighboring rotor disks of a gas turbine rotor. During the operation of a gas turbine, especially the rotors thereof are subject to high demands. In order to reduce the wear rate, the rotors are densified or hardened by special surface treating or processing methods. In that regard, it is of significance to densify or harden also the surfaces of the above described cavities with small cross-sectional areas and the associated transition radii.

For the hardening of surfaces, the shot peening or shot blasting is usually used according to the state of the art, whereby the shot balls are accelerated with the aid of an airstream or a centrifuge. If, for example, the surfaces of through-going bored holes are to be hardened with the aid of shot balls accelerated by an airstream or a centrifuge, the problem arises, that especially corners or transition areas of the through-going bored holes between a surface of the rotor and an inner surface of the through-going bored holes are subjected to a strong plastic material deformation, whereby the ductility of the material in the area of the through-going bored holes can be reduced and thus disadvantageously influenced. The methods for the surface blasting known from the state of the art are thus suitable only with great limitations for the treatment of cavities with especially tight cross-sectional areas.

SUMMARY OF THE INVENTION

Beginning from this, the problem underlying the present invention is to provide a novel method for the surface blasting of cavities, especially cavities of gas turbines.

This problem is solved by a method according to the invention, wherein shot balls are accelerated with the aid of at least one vibrator, whereby the accelerated shot balls are directed onto surfaces of a cavity that is to be blasted and the corresponding transition radii. In that regard, the vibrator is preferably positioned at a small spacing distance, preferably a spacing distance on the order of magnitude of the diameter of the shot balls used for the blasting, away from the cavity that is to be blasted.

Through the inventive acceleration of the shot balls used for the blasting with the aid of a vibrator, a random motion direction of the shot balls arises due to multiple reflections, whereby material deformations in the area of the cavities are minimized. Furthermore, a temporally smaller impulse or momentum density arises due to the smaller number of the utilized shot balls, whereby similarly the danger of material damages is reduced. In order to provide a momentum sufficient for the surface hardening despite the reduced temporal momentum density, shot balls with an adapted diameter, a higher density and therewith ultimately a greater mass are used.

According to a preferred further development of the invention, the or each ultrasonic vibrator is operated or driven with a frequency between 10 kHz and 50 kHz, especially with a frequency between 20 kHz and 40 kHz, whereby preferably shot balls with high density and hardness of a ceramic material, especially of tungsten carbide, are used for the blasting.

Preferably, the method is utilized in the blasting of through-going bored holes extending in the radial direction of a gas turbine rotor or of connecting bored holes extending in the axial direction with a relatively small cross-sectional area of especially 5 $mm^2$ to 100 $mm^2$, whereby such a through-going bored hole is first blasted in a transition area between a component surface and an inner surface of the through-going bored hole, and is then blasted in the area of the inner surface, whereby shot balls with a diameter between 0.2 mm and 5 mm, especially between 0.4 mm and 1 mm, are used for the blasting, and whereby the vibrator is operated or driven with a frequency between 10 kHz and 50 kHz, especially at 20 kHz, for the blasting of a radially outward lying transition area between the component surface and the inner surface of the through-going bored hole as well as for the blasting of the inner surface, whereas however the ultrasonic vibrator is operated or driven with a frequency between 10 kHz and 50 kHz, especially at 40 kHz, for the blasting of a radially inward lying transition area between the component surface and the inner surface.

BRIEF DESCRIPTION OF THE DRAWINGS

Preferred further developments of the invention arise from the dependent claims and the following description. Example embodiments of the invention will be explained more closely in connection with the drawing, without being limited hereto. Thereby:

DETAILED DESCRIPTION OF EXAMPLE EMBODIMENTS OF THE INVENTION

In the following, the present invention will be described in greater detail with reference to FIGS. 1 to 6.

Figure 1:
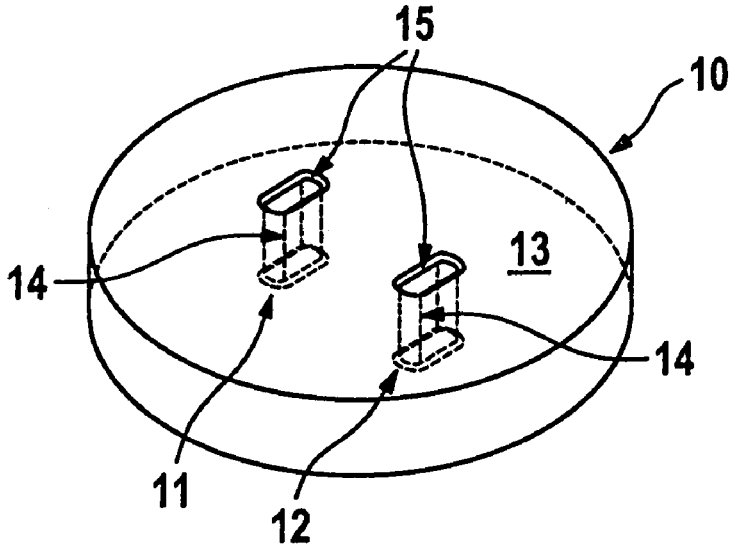
FIG. 1 shows a strongly schematized illustration of a component with two through-going bored holes to be blasted.

FIG. 1 shows a disk-shaped embodied component 10 with two through-going bored holes 11 and 12. The through-going bored holes 11 and 12 are bored holes with a relatively small cross-sectional area, especially with a cross-sectional area of 5 $mm^2$ to 100 $mm^2$. In the example embodiment of the FIG. 1, one shall begin from the point that the through-going bored holes 11, 12 comprise an oval cross-sectional area with a length of 3.8 mm and a width of 1.2 mm. Already from this it follows that the dimensions of the through-going bored holes 11, 12 are very small.

With the present invention, a method is now proposed, to densify or harden especially hollow spaces or cavities with such small dimensions, on their surfaces, by shot blasting. For this purpose, in the sense of the present invention, the shot balls are accelerated with the aid of at least one ultrasonic vibrator, especially with the aid of a so-called ultrasonic sonotrode whereby the thusly accelerated shot balls are then directed onto the surfaces of the cavity to be blasted.

In the sense of the present invention, in that regard, the or each ultrasonic vibrator is operated or driven with a frequency between 10 kHz and 50 kHz, especially with a frequency between 20 kHz and 40 kHz. Preferably shot balls of a ceramic material, preferably of tungsten carbide, are utilized for the blasting. Shot balls of a steel alloy, preferably of a 100Cr6 material, can also be utilized. The shot balls used for the blasting preferably have a polished surface and a diameter that is matched or adapted to the dimensions of the cavity to be blasted.

Preferably shot balls with a diameter between 0.2 mm and 5 mm, especially between 0.4 mm and 1 mm, are used for the blasting of the through-going bored holes 11, 12 with small cross-sectional areas as described with reference to FIG. 1.

One preferably proceeds in a two-staged manner for the blasting of the through-going bored holes 11, 12 of the component 10 according to FIG. 1. In a first stage, corner areas or transition areas between a surface 13 of the component 10 and an inner surface 14 of the through-going bored holes 11 or 12 are blasted. The corner areas or transition areas are identified in FIG. 1 by the reference number 15 and form, in the illustrated example embodiment, a radii-shaped transition between the surface 13 of the component 10 and the inner surface 14 of the respective bored hole 11 or 12. Following the blasting of the transition areas 15, then the blasting of the inner surfaces 14 of the through-going bored holes 11 and 12 occurs.

Figure 2:
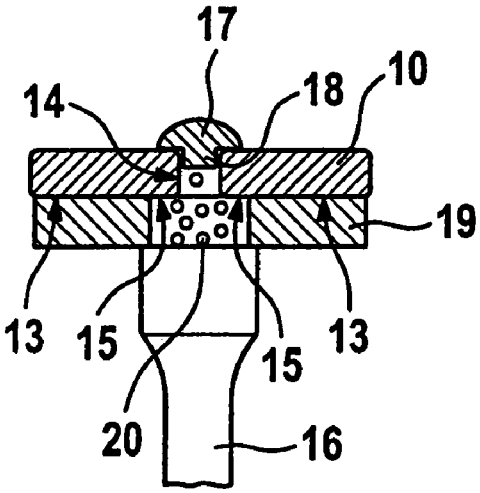
FIG. 2 shows the blasting of a corner area or transition area between a component surface and an inner surface of the through-going bored hole of the component of the FIG. 1.

For the blasting of the corner areas or the transition areas 15 between the surface 13 of the component 10 and the inner surface 14 of the through-going bored holes 11 or 12, one proceeds as shown in FIG. 2. An ultrasonic vibrator, namely an ultrasonic sonotrode 16, is arranged for this purpose in the area of a surface 13 of the component 10 with a small spacing distance relative to the through-going bored hole 11 or 12 that is to be blasted. On the opposite surface 13, the through-going bored hole 11 or 12 is closed with a closure plug 17. The closure plug 17 can reach into the through-going bored hole 11 or 12 with a projection 18 according to FIG. 2. The areas of the surface 13, which do not belong to the transition area 15 of the through-going bored holes 11 or 12 that is to be blasted, are covered with the aid of a cover 19, whereby the cover 19 simultaneously can form a spacer or spacing member for maintaining the spacing distance between the sonotrode 16 and the component 10. In the example embodiment of the FIG. 2, the spacing distance between the sonotrode 16 and the surface 13 of the component 10 during the blasting of the transition areas 15 lies in the range of a few millimeters, preferably in the range of the five-fold to fifty-fold diameter of the shot balls 20 used for the blasting. Preferably, shot balls 20 with a diameter between 0.4 mm and 1 mm are used for the blasting of such through-going bored holes.

Figure 3:
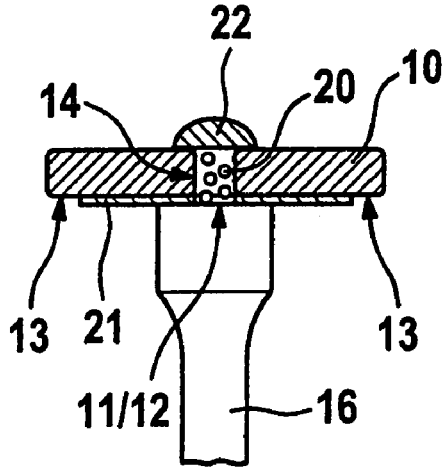
FIG. 3 shows the blasting of the inner surface of the through-going bored hole of the component of the FIG. 1.

For the blasting of the inner surfaces 14 of the through-going bored holes 11 and 12, one proceeds as shown in FIG. 3. For this purpose, once again, a sonotrode 16 is positioned with a small spacing distance relative to the surface 13 of the component 10, whereby the entire surface 13 and therewith also the transition area 15 that was previously blasted in the sense of FIG. 2 are covered by a cover 21. The cover 21 moreover again forms a spacer or spacing member for maintaining a defined spacing distance between the sonotrode 16 and the component 10. For the blasting of the inner surface 14 of the through-going bored holes 11 and 12, a smaller spacing distance is maintained between the sonotrode 16 and the surface 13 of the component 10, as can be seen from a comparison of the FIGS. 2 and 3. In connection with the blasting of the inner surfaces 14, this spacing distance lies on the order of magnitude of the diameter of the shot balls used for the blasting, especially on the order of magnitude of half the diameter thereof. When using shot balls with a diameter of 0.4 mm to 1 mm this means that the spacing distance between the sonotrode 16 and the cover 21 lies between 0.2 mm and 1 mm during the blasting of the inner surfaces 14. As can be seen from FIG. 3, also during the blasting of the inner surfaces 14, the through-going bored holes 11 or 12, on the side thereof lying opposite the sonotrode 16, are closed by a closure plug 22, whereby the closure plug 22 does not, however, project into the through-going bored hole 11 or 12.

Figure 4:
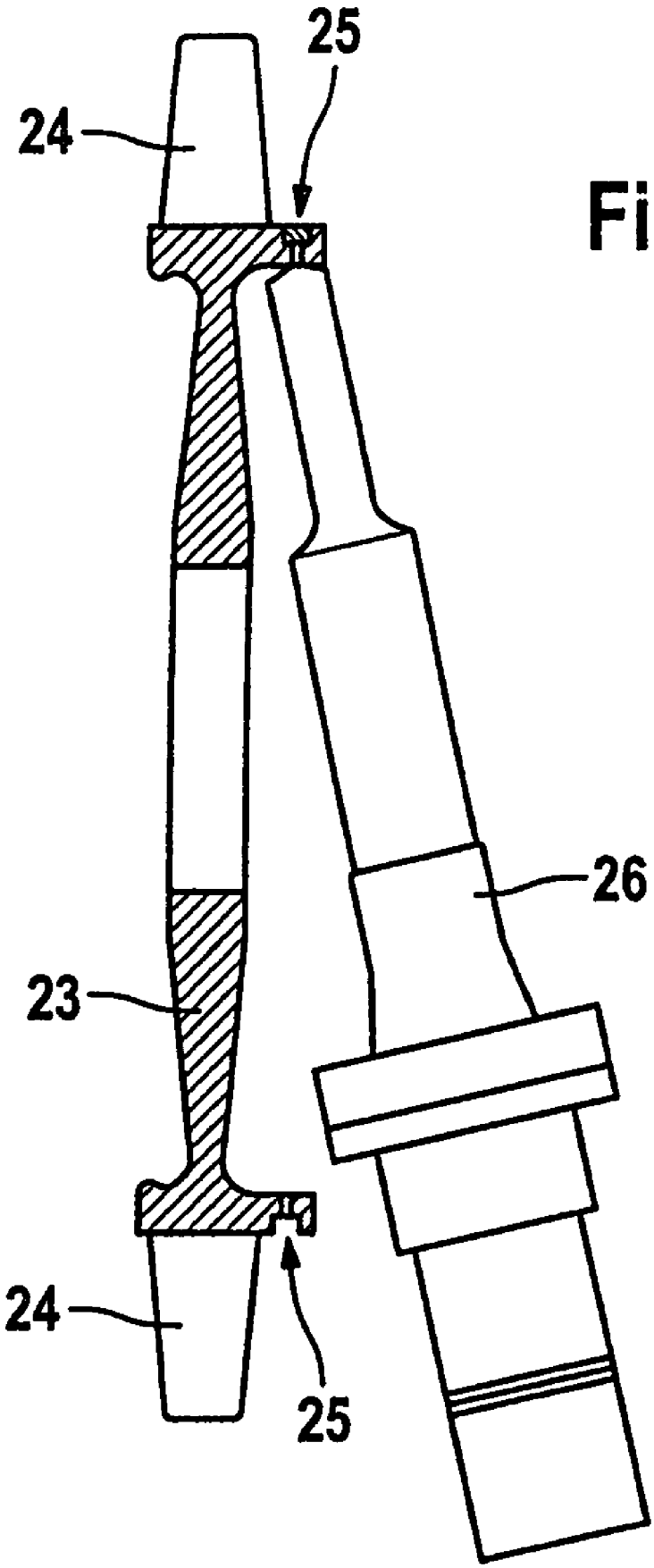
FIG. 4 shows a strongly schematized illustration of an integral bladed gas turbine rotor during the blasting, from radially inside, of a through-going bored hole extending in the radial direction.
Figure 5:
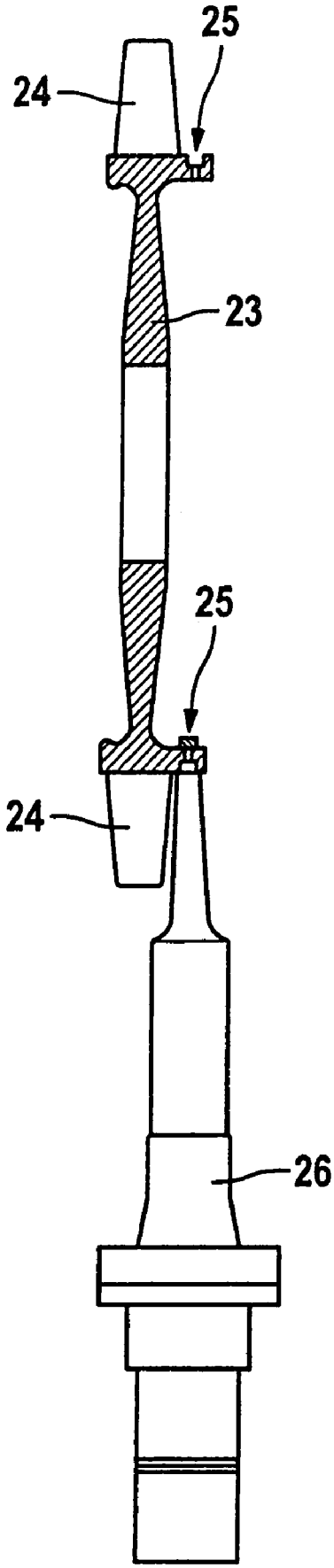
FIG. 5 shows a strongly schematized illustration of an integral bladed gas turbine rotor during the blasting, from radially outside, of a through-going bored hole extending in the radial direction.

FIGS. 4 and 5 show a rotor disk 23 of an integral bladed rotor, whereby the rotor blades of the integral blades rotor 23 are identified with the reference number 24. As can be seen from FIGS. 4 and 5, through-going bored holes 25 extending in the radial direction are integrated into the rotor disk 23, whereby the through-going bored holes serve for the passage of fluids, especially of oil. The through-going bored holes 25 can be compared with the through-going bored holes 11 or 12 according to FIG. 1 with regard to their geometrical dimensions, so that one may in principle proceed as described in connection with FIGS. 1 to 3 for the blasting of the through-going bored holes 25, which extend in the radial direction, of the rotor disk 23.

FIG. 4 shows the blasting, from radially inside, of the through-going bored holes 25, which extend in the radial direction, of the rotor disk 23, FIG. 5 shows the blasting of the same from radially outside. In the blasting of such through-going bored holes 25 on rotor disks 23, one proceeds in the sense of the present invention, so that an ultrasonic vibrator, namely an ultrasonic sonotrode 26, is operated or driven with a frequency from 10 kHz to 50 kHz, especially at 20 kHz, for the blasting of the radially outwardly lying corner areas or transition areas between a radially outwardly lying surface of the rotor disk 23 and an inner surface of the through-going bored holes 25 as well as for the blasting of the inner surfaces of the through-going bored holes 25. On the other hand, for the blasting of a radially inwardly lying corner area or transition area between a radially inwardly lying surface of the rotor disk 23 and the inner surface of the through-going bored holes 25 extending in the radial direction, the ultrasonic sonotrode 26 is operated or driven with a frequency of 10 kHz to 50 kHz, especially at 40 kHz.

The number of the shot balls used for the blasting and the time duration of the ultrasonic shot blasting are determined dependent on the desired internal residual stress profile to be achieved and the size of the cavity to be blasted.

Figure 6:
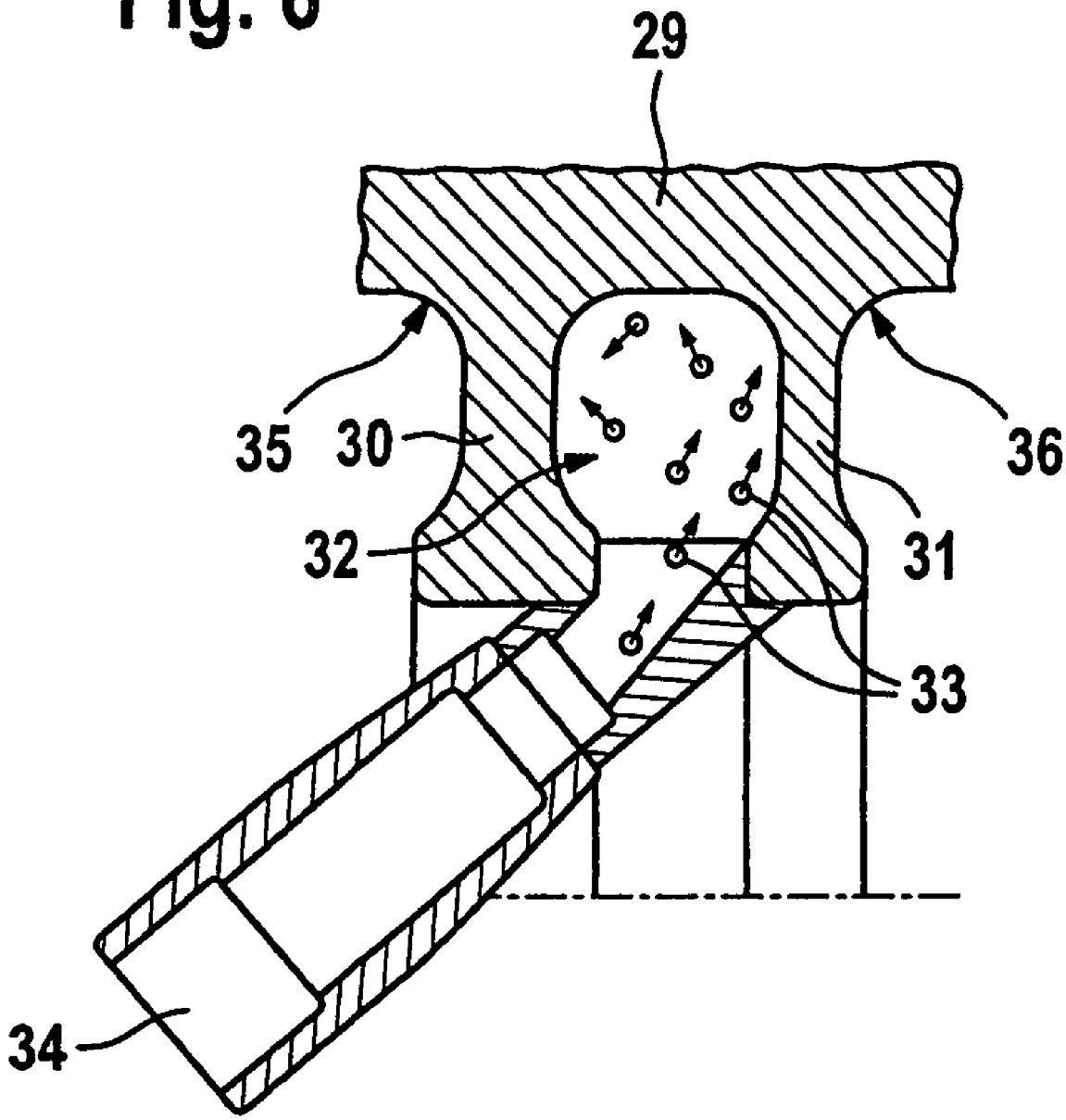
FIG. 6 shows a strongly schematized illustration of a gas turbine rotor during the blasting, from radially inside, of a cavity between two rotor disks.

The inventive method for the surface blasting of cavities is suitable not only for the blasting of cavities embodied as through-going bored holes or connecting bored holes, but rather also for the blasting of cavities between neighboring rotor disks of a gas turbine rotor. Thus FIG. 6 shows a cut-out section of a gas turbine rotor 29 which comprises two neighboring rotor disks 30 as well as 31. In the sense of the present invention, a hollow space or cavity 32 between the two neighboring rotor disks 30 as well as 31 can also be densified or hardened with the aid of shot balls 33, which are accelerated by an ultrasonic vibrator, namely, an ultrasonic sonotrode 34. For the blasting of the cavity 32 between the two rotor disks 30 and 31 as shown in FIG. 6, once again preferably shot balls of tungsten carbide or a 100Cr6 material are used, which comprise a larger diameter in distinction to the surface blasting of through-going bored holes. Thus, preferably shot balls with a diameter of 0.5 mm to 6 mm, preferably 2 mm, are used for the surface blasting of the cavity 32. A bounded or limited blasting cavity can be formed by two separating disks that are to be introduced into the cavity to be blasted, wherein the ultrasonic sonotrode forms the deepest point in the limited blasting cavity. It is pointed out that not only the cavity between the two rotor disks 30 and 31, as described above, can be blasted, but rather also the side flanks 35 or 36 of the rotor disk 30 or 31.

In the sense of the present invention, an ultrasonic shot blasting process is proposed for the surface densification or hardening of cavities, whereby the shot balls are accelerated with the aid of an ultrasonic vibrator, namely with the aid of an ultrasonic sonotrode. The diameter of the shot balls is matched or adapted to the cavity to be treated, whereby preferably shot balls of tungsten carbide are utilized. The shot balls have a polished surface.

Because smaller velocities of the shot balls occur and moreover a randomly distributed motion direction of the shot balls arises with the ultrasonic shot blasting, therefore the risk of plastic deformations in the area of the blasted cavities, especially on the edges, is minimized. Hereby it is avoided that the ductility of the material, of which the component to be hardened is formed, becomes unacceptably reduced.

The invention claimed is:

1. A method of surface blasting a cavity of a component, comprising the steps:

a) providing a component that is to be surface blasted, wherein said component is bounded by a component surface, said component has at least one cavity therein comprising a through-going bored hole or a connecting bored hole, said bored hole is bounded by an inner surface of said component, and said component further has a surface transition area including a transition radius between said component surface and said inner surface;

b) accelerating shot balls using at least one vibrator to provide accelerated shot balls; and c) surface blasting said cavity of said component by directing said accelerated shot balls first onto said transition area including said transition radius and then onto said inner surface bounding said bored bole.

2. The method according to claim 1, wherein said component is a component of a gas turbine.

3. The method according to claim 2, wherein said component of said gas turbine is a rotor of said gas turbine.

4. The method according to claim 3, wherein said rotor of said gas turbine is an integral bladed gas turbine rotor.

5. The method according to claim 3, wherein said through-going bored hole extends in a radial direction of said rotor of said gas turbine, or said connecting bored hole extends in an axial direction of said rotor of said gas turbine.

6. The method according to claim 3, wherein said rotor comprises plural neighboring rotor disks, and said cavity is a radially inwardly lying cavity in said rotor between said neighboring rotor disks.

7. The method according to claim 6, wherein said shot balls have a diameter between 0.5 mm and 6 mm.

8. The method according to claim 7, wherein said diameter is 2 mm.

9. The method according to claim 3, wherein said rotor comprises a rotor disk, and said component surface and said surface transition area are on a side flank of said rotor disk.

10. The method according to claim 9, wherein said shot balls have a diameter between 0.5 mm and 6 mm.

11. The method according to claim 10, wherein said diameter is 2 mm.

12. The method according to claim 1, wherein said shot balls are made of a ceramic material.

13. The method according to claim 12, wherein said ceramic material is tungsten carbide.

14. The method according to claim 1, wherein said shot balls are made of a steel alloy.

15. The method according to claim 14, wherein said steel alloy is a 100Cr6 alloy.

16. The method according to claim 1, wherein said shot balls each respectively have a polished surface and a ball diameter corresponding to a portion of a dimension of said cavity.

17. The method according to claim 1, wherein said bored hole has a cross-sectional area in a range from 5 $mm^2$ to 100 $mm^2$.

18. The method according to claim 1, wherein said vibrator comprises an ultrasonic sonotrode.

19. The method according to claim 1, wherein said step b) further comprises driving said vibrator at a frequency between 10 kHz and 50 kHz.

20. The method according to claim 19, wherein said frequency is between 20 kHz and 40 kHz.

21. The method according to claim 19, wherein:

said component surface of said component includes a radially outer component surface portion and a radially inner component surface portion with respect to a radial direction of said component, said at least one cavity comprises a first one and a second one of said through-going bored hole respectively bounded by a first one and a second one of said inner surfaces, said first through-going bored hole extends in said radial direction through said radially outer component surface portion with a first said surface transition area between said radially outer component surface portion and said first inner surface, said second through-going bored hole extends in said radial direction through said radially inner component surface portion with a second said surface transition area between said radially inner component surface portion and said second inner surface, and said step c) includes surface blasting said first surface transition area and said first inner surface of said first through-going bored hole with said frequency of said driving of said vibrator set to 20 kHz, and surface blasting said second surface transition area and said second inner surface of said second through-going bored hole with said frequency of said driving of said vibrator set to 40 kHz.

22. The method according to claim 1, before said steps b) and c) further comprising positioning said vibrator at a small spacing distance away from said cavity, and then carrying out said steps b) and c) with said vibrator positioned at said small spacing distance away from said cavity.

23. The method according to claim 22, wherein said spacing distance is in a range from 1 millimeter to 50 millimeters.

24. The method according to claim 22, wherein said spacing distance is on an order of magnitude of a diameter of said shot balls.

25. The method according to claim 22, wherein said spacing distance corresponds to one-half of a diameter of said shot balls.

26. The method according to claim 1, wherein said shot balls have a diameter between 0.2 mm and 5 mm.

27. The method according to claim 26, wherein said diameter is between 0.4 mm and 1 mm.

28. The method according to claim 1, further comprising providing a selected number of said shot balls to be used in said steps b) and c), for said step b) exciting said vibrator to an amplitude selected dependent on said number of said shot balls and a size of said cavity, and carrying out said step c) for a time duration selected dependent on said number of said shot balls and said size of said cavity.

* * * * *